United States Patent [19]

Ezekiel

[11] 4,167,726

[45] Sep. 11, 1979

[54] MAGNETIC LIQUID PROTECTOR

[76] Inventor: Frederick D. Ezekiel, 75 Allen St., Lexington, Mass. 02173

[21] Appl. No.: 849,223

[22] Filed: Nov. 7, 1977

[51] Int. Cl.[2] ..... H01C 1/02

[52] U.S. Cl. ..... 338/231; 338/2; 338/334; 338/5

[58] Field of Search ..... 338/231, 334, 2, 5, 338/4, 32 R; 335/47

[56] References Cited

U.S. PATENT DOCUMENTS 2,500,953 3/1950 Libman ..... 338/32 R 3,906,415 9/1975 Baker ..... 335/47

OTHER PUBLICATIONS

Francis J. Lavoie, Magnetic Fluids Engineering Kit and Applications Sketches, Ferrofluidics Corporation.

*Primary Examiner*—C. L. Albritton
*Attorney, Agent, or Firm*—Charles Hieken

[57] ABSTRACT

An external magnetic field retains a layer of magnetic liquid as a protective covering over an element, such as in slide wire potentiometers and in pressure measuring diaphragms.

7 Claims, 4 Drawing Figures

MAGNETIC LIQUID PROTECTOR

BACKGROUND OF THE INVENTION

The present invention relates in general to protecting elements and mechanisms from the atmosphere and other invironments and more particularly concerns novel apparatus and techniques for economically and reliably protecting elements such as electronic potentiometers and pressure transducers from the effects of oxidation, humidity, dirt and contaminants with a negligible increase in cost that is relatively inexpensive and easy to fabricate without interfering with the function of the component.

In order to protect certain elements from the adverse effects of the surrounding environment, coverings such as paints or rubberized material may be used. These coverings, although perfectly acceptable in many applications, pose certain difficulties where relative motion must be permitted after the covering is installed. Another method is to fill the cavity wherein this element is located with an inert gas or liquid. To prevent this liquid or inert gas from escaping, a seal is installed to permit access through the liquid or gas. Frequently, seals can be designed to meet the performance desired. For example, to protect a rotary potentiometer, a shaft seal is installed around the rotary shaft. For protecting a pressure measuring transducer, an isolation diaphragm is used to seal a certain amount of an inert liquid, such as silicone, between the transducer and one side of the isolation diaphragm. In this method, an external pressure can be measured by the transducer after the pressure has been communicated through the liquid.

It is an important object of the invention to provide improved apparatus and techniques for protecting elements from contamination.

It is an object of the invention to protect a pressure deformable diaphragm without interfering with its operational characteristics such as spring rate, hysteresis and other parameters.

It is a further object of the invention to achieve the preceding objects while allowing relative movement between at least one protected element and another element.

It is still another object of the invention to achieve one or more of the preceding objects while protecting electrical elements, such as potentiometers, strain gauges and pressure transducers.

It is still a further object of the invention to achieve one or more of the preceding objects with apparatus that is relatively inexpensive, reliable and relatively easy to install.

SUMMARY OF THE INVENTION

According to the invention, an element to be protected is located in a magnetic field which retains a magnetic liquid in covering relationship with the element. The source of the magnetic field may be a permanent magnet and the protected elements may be the contacting elements of a potentiometer.

Numerous other features, objects and advantages of the invention will become apparent from the following specification when read in connection with the accompanying drawing in which:

DETAILED DESCRIPTION OF PREFERRED EMBODIMENTS

Figure 1:
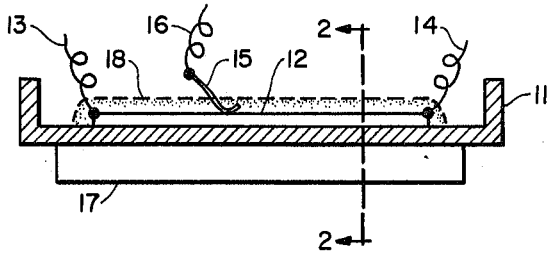
FIG. 1 is a longitudinal sectional view through a linear potentiometer according to the invention.
Figure 2:
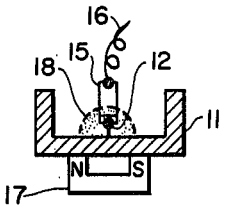
FIG. 2 is a transverse sectional view through section 2—2 of FIG. 1.

With reference now to the drawing and more particularly FIG. 1 thereof, there is shown a longitudinal sectional view through a linear potentiometer according to the invention. An insulating case 11 supports a fixed resistance 12 between end terminals 13 and 14 contacted by a sliding contact 15 connected to a terminal 16 in a conventional manner well-known in the art. A permanent magnet 17 separated from fixed wire 12 by the casing 11 establishes a magnetic field for retaining magnetic fluid 18 around fixed wire 12 and in the region in which sliding contact 15 contacts fixed resistance 12 so that sliding contact 15 may mocve from one end of resistive element 12 to the other while immersed in magnetic fluid 18 so that both fixed and sliding contacts are protected from oxidation and other contaminants. FIG. 2 is an end sectional view through section 2—2 of FIG. 1.

Figure 3:
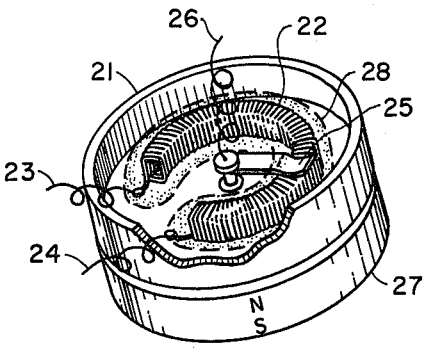
FIG. 3 is a diagrammatic representation of a rotary potentiometer incorporating the invention.

With reference to FIG. 3, there is shown a pictorial representation of a rotary potentiometer incorporating the principles of the invention. This embodiment of the invention includes an insulating case 21 formed with a circular groove for accommodating a circular fixed resistance wire 22 connected between an end contact 23 and an end contact 24 contacted by sliding contact 25 connected to sliding contact terminal 26. Magnetic liquid 28 surrounds fixed resistance wire 22 in the magnetic field established by a permanent magnet 27 beneath.

In all the specific examples shown the permanent magnet used is not in contact with the magnetic liquid but is separated from the liquid by a barrier. In many cases the magnet can be located in close proximity to the element to be protected with magnetic liquid being attracted and immediately surrounding the magnetic poles.

Figure 4:
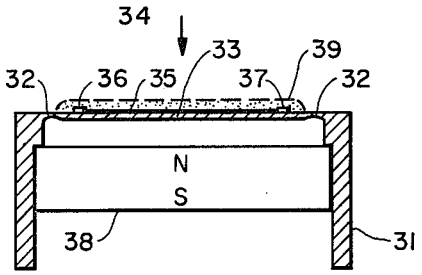
FIG. 4 is a sectional view through a semiconductor pressure transducer incorporating the principles of the invention.

Referring to FIG. 4, there is shown still another embodiment of the invention comprising a pressure transducer of the semiconductor strain gage variety. Housing 31 is usually cuplike in shape made out of a special material such as silicon. Circular groove 32 defines diaphragm 33 which is thin enough to be pressure responsive. Strain gage conductors 35 are usually deposited, etched or glued to the deflecting diaphragm 33 under the action of an external pressure applied in direction 34. Terminals 36 and 37 can be used for conducting the electrical signal. Permanent magnet 38 shown schematically attached to housing 31 is used to capture magnetic liquid 39 which is designed to cover the deformable diaphragm 33 and its associated electrical conductors 35. Thus by providing the liquid cover, the pressure transducer can be protected from humidity, corrosive vapors and other contaminations without interfering with its delicate operation.

The specific form of the elements comprising the invention is well known in the art. The potentiometers and pressure or strain gauges may be substantially the same as commercially available units. The magnetic fluid may be that commercially available from a number of sources, such as Magnetic Liquid Division of Servoflo Corporation and Ferrofluidics Corporation.

This magnetic fluid typically comprises a colloidal suspension of fine iron oxide particles dispersed in a diester carrier. The permanent magnets may be ribbon flexible permanent magnets that may be cut off to an appropriate length and shaped in a manner to hold the magnetic fluid where desired.

An important advantage of capturing a magnetic liquid over the element to be protected, is the retention of this liquid cover irrespective of the gravitational orientation of the device wherein this element is contained. Typically, an element measuring one or two inches in its longest dimension can be covered with magnetic liquid and have this liquid retained by a small magnetic field whether the element is right side up, upside down or sideways without losing the magnetic liquid cover. In addition shock and vibrational effects can be tolerated without the loss of the magnetic liquid. Or course, depending on the strength of the magnetic liquid and the strength of the magnetic field relatively long elements can be protected.

Where electrical contacts are to be protected, it is ordinarily preferred that the magnetic liquid be a good insulator; otherwise the performance of the device may be altered by the presence of the liquid. Important properties of this liquid are its high insulating properties and its low vapor pressure for long term minimal evaporation.

There has been described novel apparatus and techniques for economically and effectively inhibiting contamination of various elements, especially in electrical devices: Among these devices are electronic watches, especially the IC chips. Numerous other devices may be protected according to the invention. It is apparent that those skilled in the art may now make numerous other uses and modifications of the departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Apparatus for protecting from contamination comprising, an electrical element subject to contamination whose electrical properties would be adversely affected by such contamination to be protected from the adverse effects of surrounding environment, means for establishing a magnetic field in the region of said element to be protected from contamination, and magnetic liquid covering said element in said region and continuously retained there by said magnetic field to prevent said element from being contaminated from the surrounding environment.

2. Apparatus for protecting from contamination in accordance with claim 1 wherein said means for establishing a magnetic field comprises a permanent magnet adjacent to said element to be protected.

3. Apparatus for protecting from contamination in accordance with claim 1 wherein said element comprises an electrical potentiometer and said region comprises the region traversed by a sliding contact of said potentiometer in contact with a fixed contact.

4. Apparatus for protecting from contamination in accordance with claim 1 wherein said element comprises a force sensitive element.

5. Apparatus for protecting from contamination in accordance with claim 4 and further comprising semiconducting material in contact with said force sensitive element responsive to deflection thereof for altering the conductivity of said semiconductive material.

6. Apparatus for protecting from contamination in accordance with claim 1 wherein said element is electrical and said magnetic liquid is a good insulator.

7. Apparatus for protecting from contamination in accordance with claim 6 wherein said element is an electrical conductor arranged to carry an electrical current in a normal operating mode.

* * * * *